US005809812A

United States Patent [19]

Gallego

[11] Patent Number: 5,809,812

[45] Date of Patent: Sep. 22, 1998

[54] SECURITY DEVICE FOR ELECTRONIC LOCKS

[75] Inventor: Luis Valdajos Gallego, Fuenterrabia, Spain

[73] Assignee: Talleres de Escoriaza, S.A., Spain

[21] Appl. No.: 598,028

[22] Filed: Feb. 7, 1996

[30] Foreign Application Priority Data

Feb. 7, 1995 [ES] Spain ..... 9500235

[51] Int. Cl.[6] ..... E05B 59/00

[52] U.S. Cl. ..... 70/107; 70/276; 70/278; 292/21; 292/34

[58] Field of Search ..... 70/107–111, 276–278, 70/283, 129; 292/21, 34

[56] References Cited

U.S. PATENT DOCUMENTS

| | | | |
|---|---|---|---|
| 3,604,229 | 9/1971 | Wake | 70/107 |
| 3,791,180 | 2/1974 | Doyle | 70/107 |
| 3,999,789 | 12/1976 | Maurits et al. | 70/107 X |
| 4,129,019 | 12/1978 | Urdal | 70/107 |
| 4,709,565 | 12/1987 | Lin | 70/107 |
| 4,809,526 | 3/1989 | Shen | 70/107 |
| 4,838,053 | 6/1989 | Shen | 70/107 X |
| 5,027,629 | 7/1991 | Liu | 70/107 X |
| 5,161,837 | 11/1992 | O'Brien, II | 292/21 X |
| 5,325,687 | 7/1994 | Lin | 70/107 |

FOREIGN PATENT DOCUMENTS 834448 2/1970 Canada .

*Primary Examiner*—Lloyd A. Gall
*Attorney, Agent, or Firm*—Laff, Whitesel, Conte & Saret, Ltd.

[57] ABSTRACT

The present invention provides an electronic lock with a deadbolt actuator. The actuator has, a casing, a deadbolt shaft protruding through the casing and an eccentric in said casing attached to said deadbolt shaft to rotate with the deadbolt shaft. A pair of pusher blades are connected to an interior handle supporting tube extending into said casing. The pusher blades are connected to a main bolt shaft to rotate said pusher blades relative to each other wherein the shaft rotates one of said pusher blades while said other pusher blade is not rotated. The pusher blades are in selective contact with the eccentric and move the eccentric from a first position wherein the deadbolt is retracted and to a second position wherein the deadbolt is extended to a locking position. The deadbolt is extended and retracted by either turning the interior thumb turn or turning an exterior handle in an appropriate direction.

20 Claims, 4 Drawing Sheets

Fig1
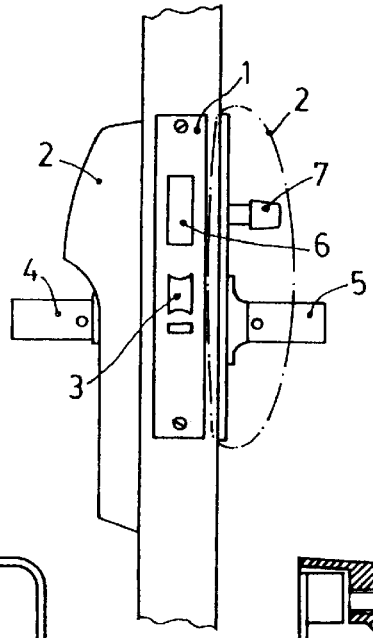
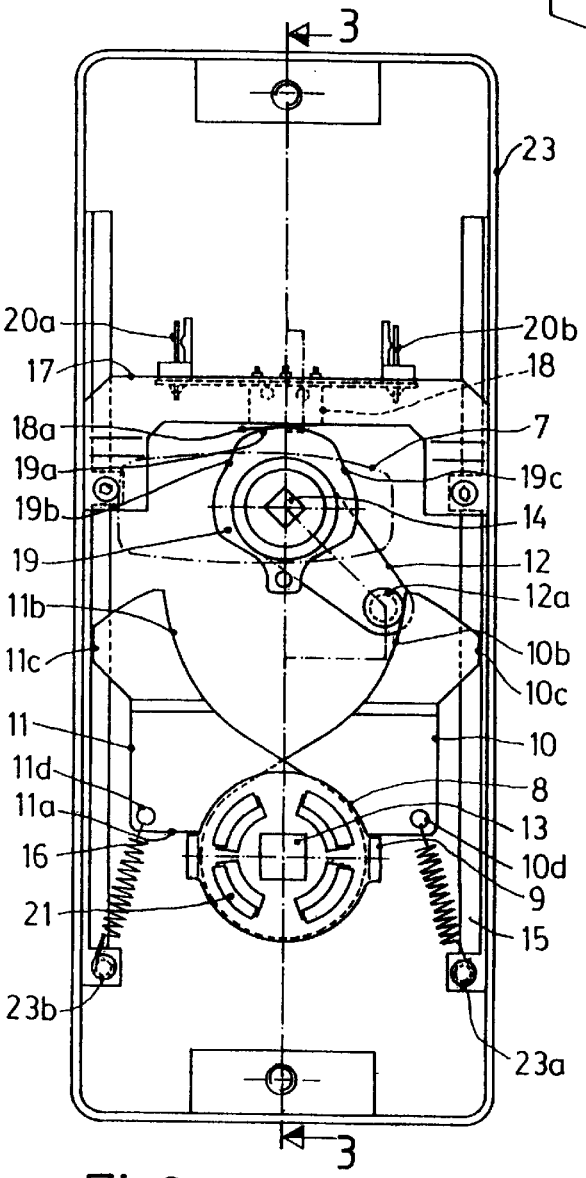
Fig2
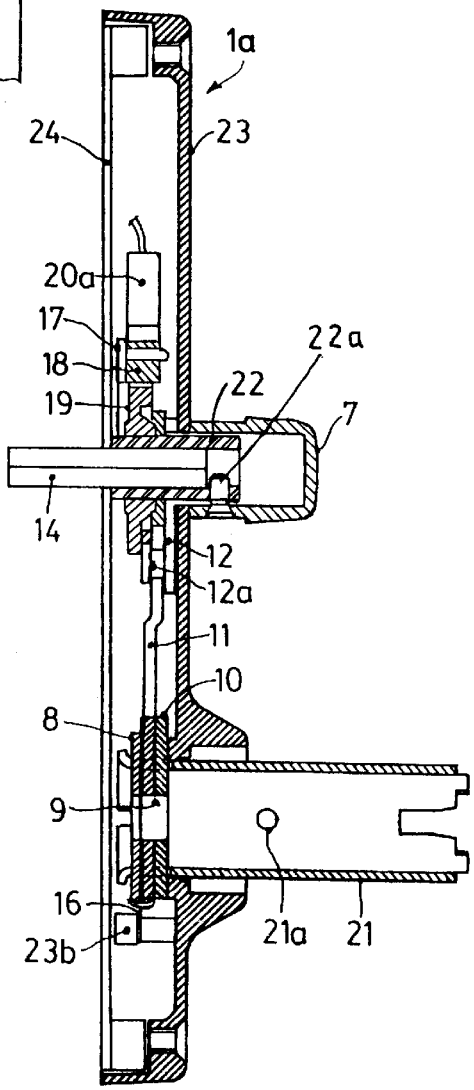
Fig3

SECURITY DEVICE FOR ELECTRONIC LOCKS

FIELD OF THE INVENTION

The present invention relates to electronic door locks and has been conveyed into its angular position of closing against the frame, it will be possible, from the external side of the lock, to actuate an additional security mechanism such as might take the form of one or more bars provided with their respective catches in the frame; and, moreover, with the particular feature that each actuation need not be implemented by a mechanical key.

More precisely, this new device is especially designed for those cases in which the locks were to incorporate, as well, a function of privacy which is provided by a bolt which can be materially produced in the additional security bar and which is actuated by means of a supporting cylinder placed through the interior side of the door.

Although the device is preferentially conceived of as being for built-in locks that can be actuated by means of a magnetic card (or by some other, similar coded instrumentality), it may likewise be applied advantageously for built-in locks that consist simply of a latch that can be actuated by a revolving handle that is lockable by key, and that consist of a privacy-ensuring bar which can only be actuated from the inside by means of a supporting cylinder. Hereinafter, wherever actuating "handle" is written, it should be understood as being equivalent to "knob", and vice versa, inasmuch as both concepts are comprised within the more general concept of "something operated in the manner of a handle."

PRIOR STATE OF THE ART

At the present time there exist many types of locations (hotels, offices, government centers, industrial facilities) where it has become customary to utilize electronic locks, in which the traditional mechanical key has been replaced by a coded electronic card. When the card is inserted in and validated by an electronic operating unit, the electronic unit releases the biased main bolt of the lock so that the rotative actuation of the exterior handle can open the door. However, there is not known in this field any device that, upon validation of the magnetic card itself, permits the door to be additionally secured or locked by a privacy-ensuring deadbolt. The electronic locks presently used only have deadbolts or a sliding latch bolt that can only be drawn from within. Also, the electronic locks presently used do not permit the privacy-ensuring bar or deadbolt engaged from within to be withdrawn by means of external validation of the magnetic card. This function would be of great interest for assisting in some accident, calamity or need for urgent attention, when the privacy-ensuring deadbolt is drawn and the person locked inside are not capacitated to manipulate the lock.

SUMMARY OF THE INVENTION

The present invention does not relate in any way to the internal or actual mechanism of the lock wherein the electronic operating unit activates and deactivates the door handles for operating the lock nor to the electronic operating unit. The invention relates to an electronic deadbolt actuator that, when incorporated into electronic locks of this type, will allow a deadbolt to be drawn from the exterior of the door by turning the door handle, i.e., upwards after the introduction of a valid magnetic card. While in a resting state, the exterior handle remains rotatively uncoupled, and its actuation in either of the two directions has no affect whatever with respect to the drawing/withdrawing of the aforementioned privacy-ensuring bolt nor the main biased locking bolt. After the introduction of the valid magnetic card, this exterior handle remains rotatively coupled for a definitive and variable period of time as deemed appropriate, during which period of time it is possible either to open the lock, by actuating the exterior handle downwards, or to draw the privacy/security deadbolt until the lodging thereof in the respective catch of the frame by actuating the exterior handle upwards.

For such purpose, the electronic deadbolt actuator has a number of reversible-actuation means that rotatively couple the shaft of the interior handle with the shaft of the deadbolt thereby selectively transmitting the rotation of the interior handle to the deadbolt. A coaxial dragger-disk is coupled rotatively with the interior handle shaft and with the supporting tube of the interior handle. The coaxial dragger disk has two dragger-lugs which, while they are in the resting state, are positioned horizontally in diametric opposition to each other and which are applied, respectively, to the foreparts of two transverse pusher blades. The pusher blades are mounted coaxially with the supporting tube of the interior handle and which, with respect to the vertical median plane of this supporting tube, extend symmetrically, diverging from each other and each exhibiting pusher parts. The pusher parts are capable of remaining operatively applied to the actuating portion of an eccentric which is rotatively attached to the shaft of the supporting cylinder. The eccentric is capable of occupying two extreme angular operative positions, in which positions such actuating portion is applied to the pusher-part of one or the other of the blades. The operative angular positions of the eccentric determine other corresponding positions in the supporting cylinder, as well as the extended (closed) and retracted (open) states of the privacy-ensuring deadbolt. The pusher blades are each mounted by means of springs which are antagonistic with respect to the operative thrust of said pusher blades. The function is that whenever the external handle is rotatively moved after the lock is activated, being rotated in an ascending direction, the deadbolt is drawn (if this is not the case previously), since the eccentric will be dragged or rotated by the corresponding pusher blade, along with which the deadbolt shaft of the supporting cylinder. The supporting cylinder itself and the shaft actuated by this supporting cylinder will also rotate integrally. When commencing from this position, the deadbolt is retracted by rotating the external handle in the descending direction.

The reversible concept of the deadbolt actuator ensures this quality of functioning, regardless of whether the door is one that opens from the left or from the right. The only thing to change will be which of the two blades will be the one to cause the implementation/retraction of the privacy-ensuring deadbolt. Of course, the handle and the supporting cylinder will be mounted in half-turned positions of rotation, for which purpose the corresponding means of fixation are provided in diametric opposition to each other, both in the supporting tube of the handle and in that of the supporting cylinder. In each case, the blade that causes the exiting or implementation of the privacy-ensuring bar will be designed as the "privacy-securing blade", whereas the other lever will be designated as the "privacy-relinquishing blade".

It is emphasized that the deadbolt actuator device is independent of whatever may be the concrete embodiments of the electronic operating unit and of the locking mechanism. The shaft of the interior handle complies with the standards that are established and adhered to in this sector of industry. Consequently, the device is universally applicable to the several variants of built-in mechanical locks that already exist or are yet to exist and that are components of the ensemble of electronic locks.

The deadbolt actuator device will cause the retraction/implementation of the privacy-security/ensuring deadbolt, so long as the valid magnetic card is used and so long as the exterior handle is actuated in the appropriate direction.

Within the scope of the invention there is envisioned the additional functional feature that the privacy-ensuring deadbolt can only be withdrawn by a special card that is solely at the disposal of authorized persons, if need be, and not just each time that the valid card of customary use is employed.

In order to achieve this feature, the invention offers the additional characteristic that in said shaft of the supporting cylinder there is installed a cam that exhibits a symmetrical active profile which is defined by a relatively more prominent central lobe and by relatively less prominent collateral lobes, all of which lobes operate with respect to the actuating appendage of a microswitch or "micro", which is electronically connected with said external electronic operative unit, in the production of respective states of activated "micro," by means of the collateral lobes. What is accomplished in this way is that the electronics of the operative unit distinguished whether the privacy-ensuring instrumentality is or is not drawn, depending on whether or not the "micro" is activated. When the "micro" is activated, i.e., locked from the inside (privacy ensured), the lock will only be opened by the special card; otherwise, it will be opened by the card of customary use.

In relation to this and to the reversible conception of the device, a preferential form of embodiment is provided in which the "micro" possess two outlet connectors, one of the other of which (right or left connection) is to be employed, depending on from which side the door is opened. Each of the two outlet connectors will operate with one of the aforesaid symmetrical collateral lobes of the cam which is installed on the shaft of the supporting cylinder. This makes it possible, upon the changing of the side from which the door is opened (by positioning the entire cam at 90 degrees), for the signal emitted by the "micro" to incorporate an indication of the position of the privacy-/security-ensuring deadbolt and of the type of door (opening "from the right" or "from the left") in which the deadbolt is installed.

In accordance with another feature of the invention, the pusher blades, in their dorsal aspect, have heels—one in each instance—which, when these blades are in their inactive state, remain applied against the sturdy lateral walls of the housing or containing case of the deadbolt actuator device. The housing or case is fastened in a practicable manner with respect to an anchoring plate which is, in turn, fastened to the door. This permits the excessive stresses produced by an incorrect manipulation to be directly supported by the more than sufficient strength presented by the walls of the housing or case, thereby preventing the parts of the deadbolt actuator from being broken, all of which increases the sturdiness of the whole.

In other respects, the device is versatile for varying the operative angular travel, whether it be by modifying unilaterally the dimensions of the outline of the actuating part of the eccentric, or said actuating part may be selectively positionable as regards its operative radius.

Another interesting application of the device, in its simplified version lacking both cam and "micro", is to implement the function of drawing the privacy-/security-ensuring instrumentality from the exterior in these locks which are operated by a mechanical key and which consist only of a latch activated by a handle (locked rotatively by the key) and, possibly, of an independent privacy-ensuring bolt with internal supporting cylinder. In these cases it will suffice to install the new device in order for the shafts of the supporting cylinder. In these cases it will suffice to install the new device in order for the shafts of the supporting cylinder and of the handle to be mechanically related to each other, so that, when the latter shaft exists (with the door closed against the frame, and prior to the rotative locking) by being turned in the direction contrary to that of opening, what is achieved is the drawing of the privacy-security-ensuring instrumentality, whereas, upon entering, by turning in the direction of opening, what is achieved is the simultaneous withdrawal of the privacy-ensuring instrumentality and of the main bolt.

In order that the nature of the present invention may be better understood, in the attached drawings we have represented a preferential form of industrial embodiment, the exemplifying character of which is merely illustrative and not limitative.

BRIEF DESCRIPTION OF THE DRAWINGS

FIG. 1 schematically shows perspective front view of an electronic lock which is equipped with a deadbolt actuator device of the invention.

FIG. 2 is an enlarged side view of the encircled portion 2 of the FIG. 1 showing the internal arrangement of elements.

FIG. 3 is a cross-section taken along the line 3—3 of FIG. 2.

Figure 4:
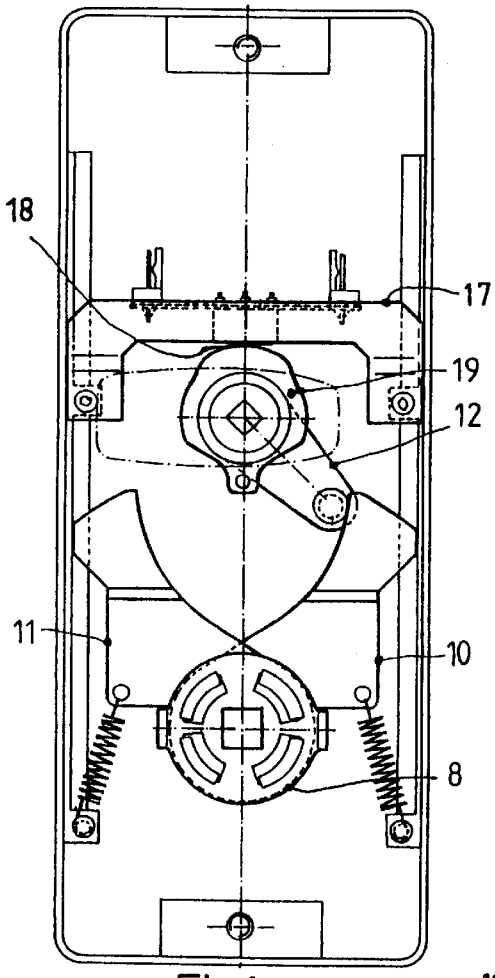
FIG. 4 is another representation of FIG. 2.
Figure 5:
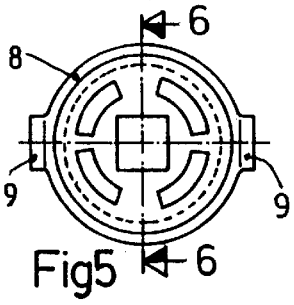
FIG. 5 is a front view of the dragger-disk as it appears in FIG. 4.
Figure 6:
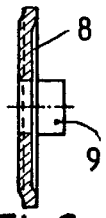
FIG. 6 is a cross-section taken along lines 6—6 of FIG. 5.
Figure 7:
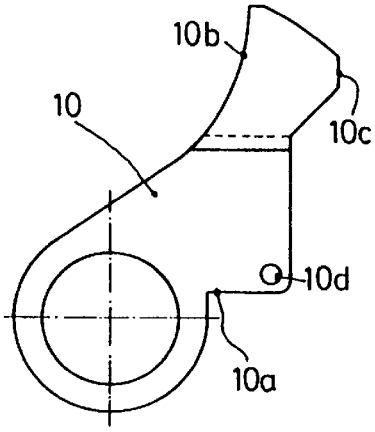
FIGS. 7 and 8 illustrate the privacy-ensuring opening pusher blade of FIG. 4.
Figure 8:
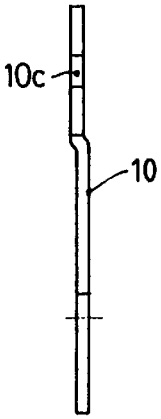
Figure 9:
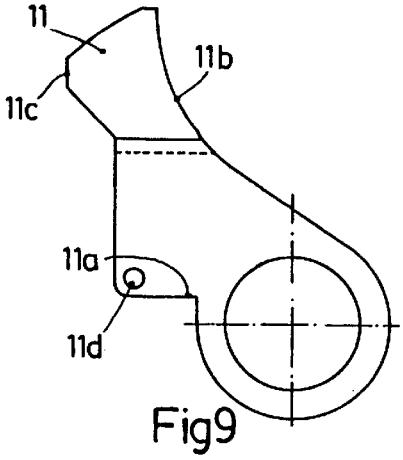
FIG. 9 and 10 illustrate the privacy-ensuring closing blade of FIG. 4.
Figure 10:
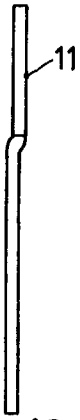

DETAILED DESCRIPTION OF THE INVENTION.

The following parts are used to describe the invention.

1. Lock

1*a*. Deadbolt actuator unit.

2. Electronic operating unit.

3. Main bolt or biased catch-bolt.

4. Exterior handle or knob.
5. Interior handle or knob.
6. Privacy-ensuring deadbolt.
7. Interior supporting cylinder or deadbolt thumb.
8. Dragger disk
9. Dragger lugs
10. Privacy ensuring opening blade (in the assembly of FIGS. 3, 4, 16 and 17).
10*a*. Impeller front or neck, on opening blade.
10*b*. Pusher part or nose on opening blade.
10*c*. Dorsal heel of seating, on opening blade.
10*d*. Spring support for opening blade.
11. Privacy ensuring closing blade.
11*a*. Impeller front or neck on closing blade.
11*b*. Pusher part or nose on closing blade.
11*c*. Dorsal heel of seating, on closing blade.
11*d*. Spring support for closing blade.
12. Actuating eccentric or supporting cylinder.
12*a*. Actuating protuberance on eccentric.
13. Biased bolt shaft.
14. Deadbolt shaft.
15. Antagonistic spring for opening blade.
16. Antagonistic spring for closing blade.
17. Microswitch support.
18. Microswitch.
18*a*. Actuating appendage of microswitch.
19. Microswitch actuating cam.
19*a*. Cam central lobe.
19*b*. Cam collateral lobe.
19*c*. Cam collateral lobe.
20*a*. Microswitch outlet connector.
20*b*. Microswitch outlet connector.
21. Supporting tube for interior handle.
21*a*. Protractible lodging or protuberances in tube.
22. Support tube for thumb.
22*a*. Screw
23. Removable casing
23*a*. Casing spring support.
23*b*. Casing spring support.
24. Anchoring plate.

Referring to the drawings and reference numbers, the attached plans illustrate a preferred embodiment of the invention which is especially designed for electronic locks such as that shown schematically in FIG. 1. The lock has a locking mechanism (1) with an electronic operating unit (2) of any of the variants already known or still to become known. The functioning of these is based on validation, by the operating unit, of a magnetic card or similar coded means that causes the activation of a rotative coupling from the rotation of the exterior handle or knob, (4) to the aforesaid locking mechanism (1), that produces the lock-opening movement. This lock-opening movement entails the retraction of the main bolt (3). In addition, there exists a privacy-ensuring deadbolt (6) which, prior to this invention, could only be drawn or withdrawn by means of the interior thumb turner (7) or exterior mechanical cylinder, but not by means of the actuation of said electronic operating unit (2).

The present invention established a mechanical connection between the biased bolt shaft (13) of the interior handle (5) and the deadbolt shaft (14) of the thumb turner (7) so that the validation of a given magnetic card will permit the drawing of the privacy-ensuring deadbolt (6) when the exterior handle (4) is actuated upwards, after permitting engagement clutch-wise, by the exterior insertion of the valid magnetic card.

Figure 11:
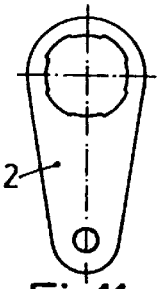
FIG. 11 shows the eccentric of FIG. 4, but without its actuating protuberance.
Figure 12:
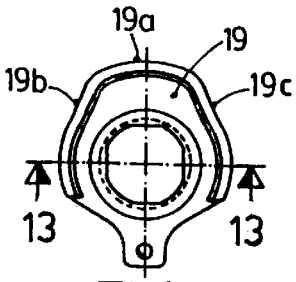
FIG. 12 shows the cam for the "micro" as it appears in FIG. 4.
Figure 14:
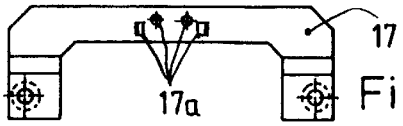
FIGS. 14 and 15 is a front view and side view of the "micro", as opposed to what appears in FIG. 4.
Figure 13:
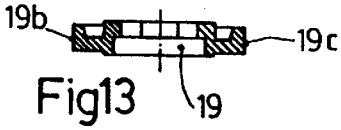
FIG. 13 is a cross-sectional view taken along the line 13—13 of FIG. 12.
Figure 15:
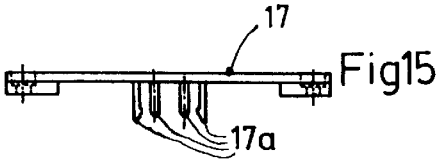
Figure 17:
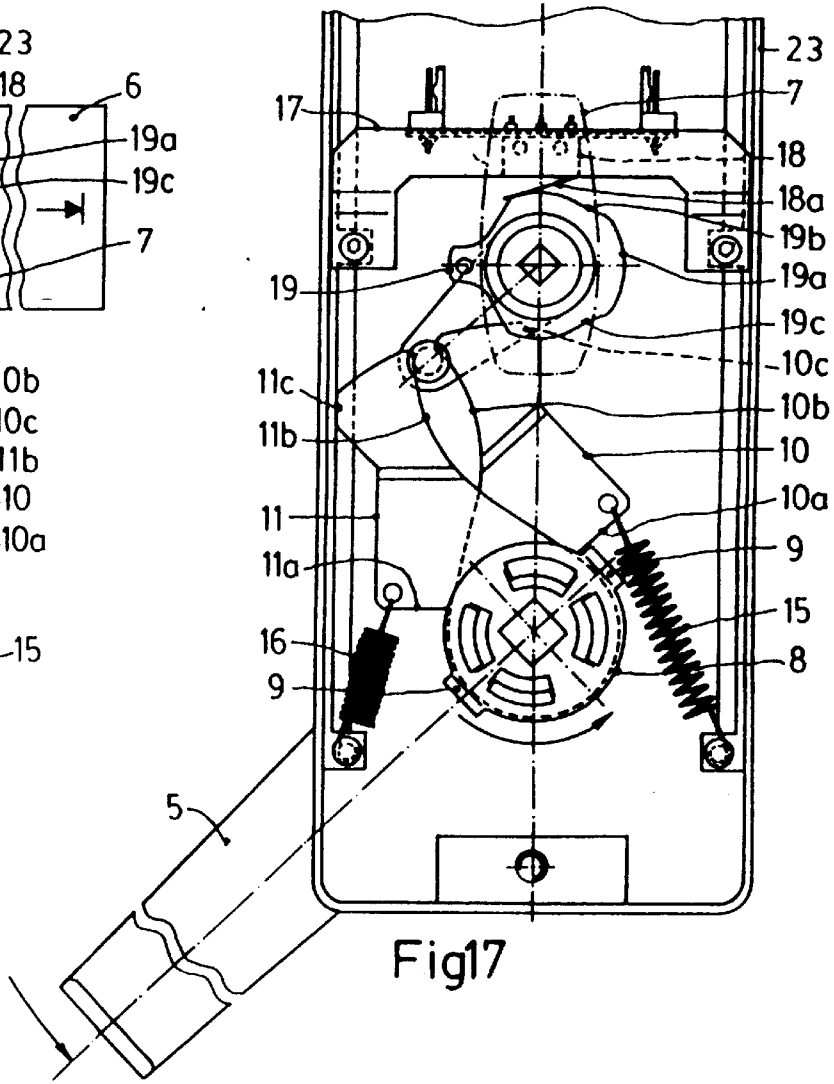
FIG. 17 illustrates the withdrawal of said privacy-ensuring deadbolt by means of the normal rotation (in the descending direction) of opening with the interior handle.
Figure 16:
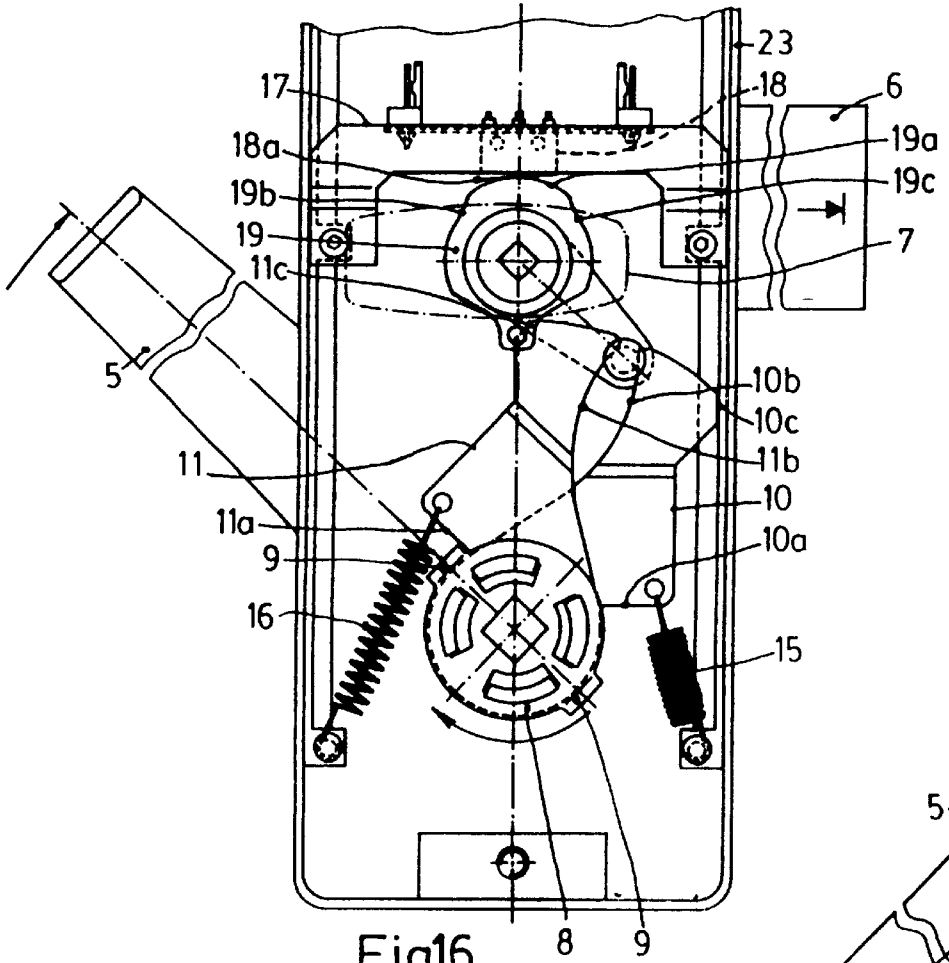
FIG. 16 illustrates the placement of the privacy-ensuring deadbolt by means of the inverse rotation (in the ascending direction) of the interior handle.

To achieve this object, we provide, referring to FIGS. 2 and 3 an electronic lock deadbolt actuator (la) that has a dragger-disk (8), which is fastened onto the biased main bolt shaft (13) and the supporting tube (21) of the interior handle (5). The pusher blades (10, 11 ) are fastened onto the supporting tube (21) so that they rotate relative to the supporting tube as shown in FIGS. 16 and 17. The eccentric (12), FIGS. 2, 3 and 11 is fastened onto the deadbolt shaft (14) of the thumb turner (7).

The arrangement of this device conforms to a symmetrical operating design, the functioning of which- is illustrated in FIG. 16 and 17. FIG. 17 shows the deadbolt moved from the locked position of FIG. 4 to the open position of FIG. 17 by the eccentric being moved from the right to the left where the privacy-ensuring deadbolt (6) is retracted. Starting with FIG. 3, the lugs 9 of the dragger disk contacts the base of the opening and closing disks 10 and 11. As the exterior handle is moved down, the one lug 9 pushes against the base of the opening pusher blade 10 and rotates the pusher blade 10 towards the closing pusher blade 11 until the protuberance (12*a*) of the eccentric (12) is supported on the pusher nose (11*b*) of the closing blade (11) as shown in FIG. 17. When handle (4) is released or brought to its neutral position, the opening blade is positioned as shown in FIG. 4 except the eccentric is on the left side in contact with the closing blade 11. When the valid card is inserted, the rotating coupling is produced and even if the door happens to be closed against the frame, it then becomes possible to cause the extension of the deadbolt (6) by actuating upwards of the exterior handle (4). As the handle moves upwards, illustrated in FIG. 16, the rotation of the clutched exterior handle (4) drags forth the aforesaid closing blade (11) from left to right by the dragger disk lug 9 contacting the base of the closing pusher blade 11. This in turn drags forth said eccentric (12) and, along with the eccentric, the rotation of shaft (14) of the deadbolt, the thumb turn (7) and the privacy-ensuring deadbolt (6), thereby reaching the final position represented in FIG. 16. When the actuation ceases, the exterior handle (4) will return to its central position of resting and the closing blade (11) will return to its initial position as indicated in FIGS. 3 and 4. Upon completion of this maneuver, the eccentric protuberance (12*a*) remains supported on the nose (10B) of the privacy-ensuring blade (10), so that, when the exterior handle (4) is actuated into descending (FIG. 17), this opening blade (10) will cause the eccentric (12) to rotate and, finally, to being about retraction of the privacy-ensuring bolt. This maneuver can also be effected from the interior handle (5), thereby invoking a veritable anti-panic function that retracts simultaneously the privacy-ensuring bolt (6) and the main bolt (3). The privacy-ensuring closing maneuver can also be effected by rotating the thumb turner (7), or with the interior handle, by actuating it into the descending direction. For needs of depiction the interior handle (5) appears represented in FIGS. 16 and 17, but this should not impede one's understanding of it as being a twin of the exterior handle (4). The springs (15, 16), are installed between the supports (23*a*and 23*b*) of the casing (23) and the supports (10*d*, 11*d*) of the blades (10, 11). The springs cause the blades to return to their positions of resting (FIGS. 3 and 4), at the same time that the handles (4, 5) return to their positions of resting, and the heels (10*c*, 11*c*) to remain firmly seated on the corresponding lateral wall of the casing (23). The casing (23) is fastened to the plate (24) which, in turn is anchored to the interior side of the door. The seating of the heels (10*c*, 11*c*) makes it possible for an adequate resistance of over-stresses for the parts.

Another embodiment of the invention is to allow an authorized special card to open the deadbolt. For this purpose, the deadbolt actuator incorporates the microswitch (18) and the cam (19). The cam 19 is fastened onto the deadbolt shaft (14), so that when the privacy-ensuring deadbolt is drawn, the precise combination of the central lobe (19*a*) of the cam (19) with the actuator (18*a*) of the microswitch (18) is required. Depending upon which one of the two outlet connectors (20*a* or 20*b*), whether it be a left-or right-hand door, is connected to the electronic lock that state is distinguished as such so that only one special card will be validated, so that from the exterior handle (4) it will be possible to open the lock by withdrawing the privacy-ensuring instrumentality simultaneously, while at the same time providing for the external indication of this state of privacy (for example, by luminous means) for when the card of customary use is inserted. When the privacy-ensuring instrumentality is not drawn, the card of customary use (and, of course, the insertion of the special card) will authorize the opening.

In this regard, combining the connections in one of the two outlet connectors (20*a* or 20*b*) of the microswitch with the position of the central lobe (19*a*) in contact or otherwise with the actuator (18*a*) causes it to emit the privacy signal, whether of the left or the right hand. For the changing of the door from a left to right or vice versa, the interior handle (5) and the exterior handle (4) and the thumb turner (7) will have to be mounted in such a way as to be rotated one-half turn, by making use of the respective reversible means of retractable protuberances (21*a*) diametrically opposed on the supporting tube (21) and of a diametrical screw-threaded drill-hole (22*a*) (for the corresponding screw) cut into the supporting tube (22).

The microswitch (18) is installed with respect to the retaining lugs (17*a*) which are incorporated into the frontal surface of the support (17), in which the outlet connectors (20*a*, 20*b*) are also implanted.

Figure 18:
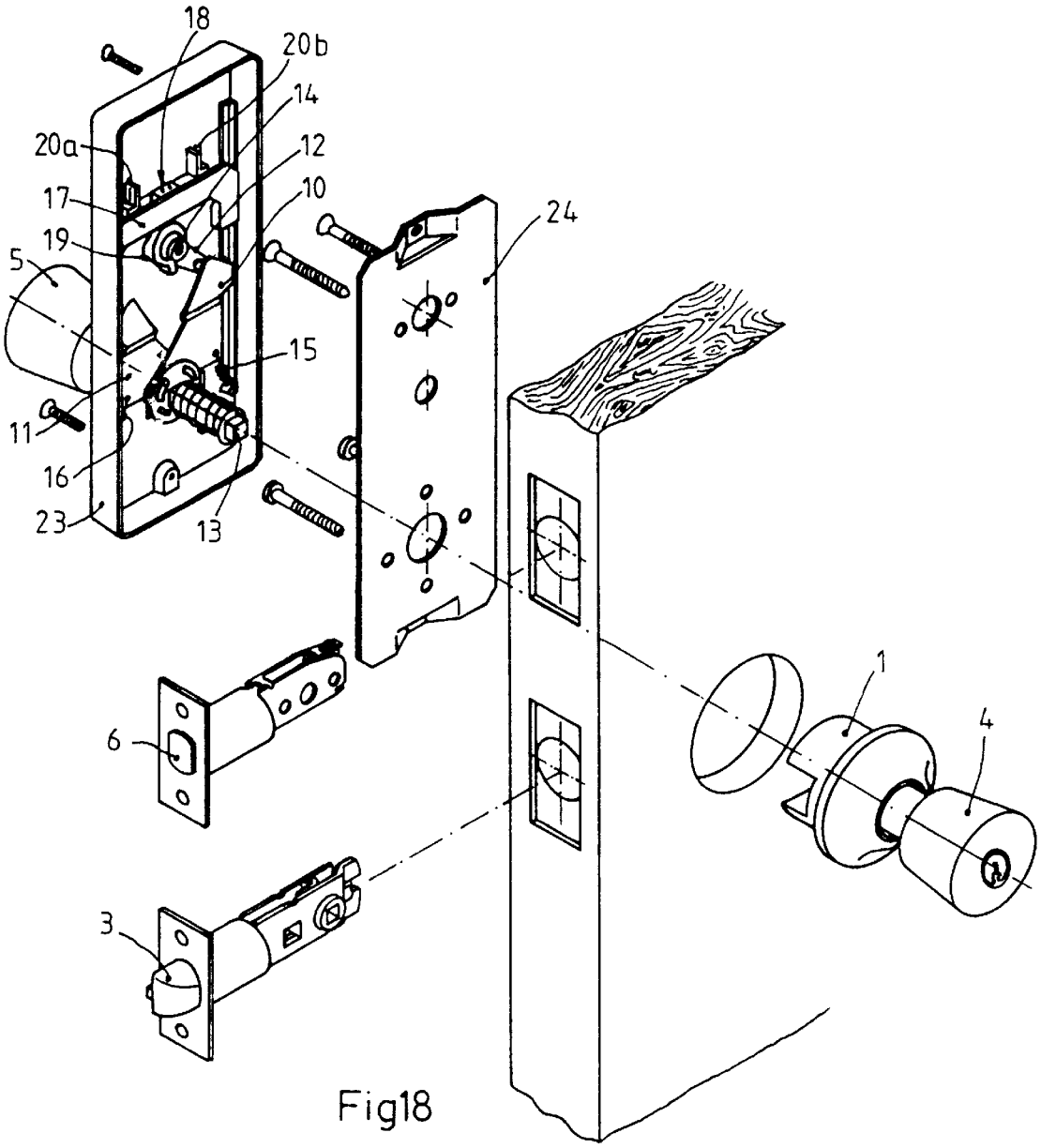
FIG. 18 is an enlarged view in perspective, which illustrates application to the housing of locking with a mechanical key.

With what has been described heretofore it should be sufficient without further explanation to comprehend the assembly of FIG. 18 which corresponding to the application of the invention for implementing the reported function of drawing the privacy-/security-ensuring deadbolt by ascending movement of the exterior handle (4), in the case of simple (and innumerable) locks operated by mechanical key, like the lock represented in those which it is customary to associate (or to be able to incorporate, if not already present) a privacy-ensuring bolt (6) that can be actuated by an interior supported cylinder (7).

The preceding description relates to a door that opens from the right side, in FIGS. 3, 4, 16 and 17. For a door that opens from the left side, as that shown in FIG. 18, the opening blade (10) becomes the closing blade (11).

The nature of the present invention having been sufficiently described as well as its industrial embodiment, it is only appropriate to add that in its overall assembly and in its component parts, it is possible to introduce changes of form, material and arrangement within the scope of the invention, provided that such alterations do not distort its basis.

I claim:

1. An improved electronic security lock having a separate deadbolt and a separate biased main bolt, a main bolt shaft connected to said biased main bolt, an interior thumb turn having a deadbolt shaft to extend and retract the deadbolt, exterior handle means and an interior handle means, an electronic operating unit connected to unlock the biased bolt when an appropriate coded card is inserted into said electronic operating unit, the improvement comprising, a deadbolt lock housing, said deadbolt shaft protruding through said housing, an eccentric in said housing attached to said deadbolt shaft to rotate with said deadbolt shaft, a first pusher blade and a second pusher blade in said housing connected to said main bolt shaft, said first and second pusher blades each having one end connected to said main bolt shaft and a second end spaced from said first end, said first and second pusher blades being connected to said main bolt shaft to rotate about and with said shaft and to rotate relative to each other wherein the main bolt shaft rotates one of said pusher blades while said other pusher blade is not rotated, said first pusher blade second end having a first nose portion facing said second pusher blade and a first heel portion contacting a first wall of said lock housing, said second pusher blade second end having a second nose portion facing said first pusher blade, and a second heel portion contacting a second wall of said lock housing, said first nose portion being spaced a predetermined distance from said second nose portion, said eccentric being movable from a first position wherein said deadbolt is retracted, to a second position wherein said deadbolt is extended in a locking position, said first nose portion being in contact with said eccentric when said deadbolt is retracted, said second nose portion being in contact with said eccentric when said deadbolt is extended into locking position, and said deadbolt being extended and retracted by either turning the said interior thumb turn or turning said exterior handle means in an appropriate direction.

2. The improved security lock of claim 1 wherein said housing has therein a dragger disk attached to the main bolt shaft to rotate with said shaft, said first and second pusher blades being mounted to rotate relative to said main bolt shaft, and means on said dragger disk to rotate the first and second pusher blades relative to each other.

3. The improved security lock of claim 2 wherein said dragger disk has a first and second integral dragger lugs diametrically opposite each other, said first dragger lug contacting said first pusher blade and second dragger lug contacting said second pusher blade when said exterior handle means is in a resting position, said first and second dragger lugs and said first and second pusher blades being constructed to enable said first dragger lug to pivot the first pusher blade and the second dragger lug to pivot the second pusher blade when said dragger disk is selectively rotated.

4. The improved security lock of claim 2 wherein a cam (19) is attached to the deadbolt shaft in said housing, said cam having a control lobe (19*a*) in contact with an actuator (18*a*) when said deadbolt is extended and said lobe being sized such that when said deadbolt is retracted, said central lobe is not in contact with said actuator.

5. The improved lock of claim 3 wherein a cam (19) is attached to the deadbolt shaft in said housing, said cam having a control lobe (19*a*) in contact with an actuator (18*a*) when said deadbolt is extended and said lobe being sized such that when said deadbolt is retracted, said control lobe is not in contact with said actuator.

6. The improved lock of claim 4 wherein said actuator is a microswitch.

7. The improved lock of claim 5 wherein said actuator is a microswitch.

8. The improved lock of claim 1 wherein the first and second pusher blades are mirror images of each other.

9. The improved lock of claim 2 wherein the first and second pusher blades are mirror images of each other.

10. The improved lock of claim 3 wherein the first and second pusher blades are mirror images of each other.

11. The improved lock of claim 4 wherein the first and second pusher blades are mirror images of each other.

12. An electronic security lock deadbolt actuator comprising, a casing, a deadbolt, a deadbolt shaft protruding through said casing, an eccentric in said casing attached to said deadbolt shaft to rotate with said deadbolt shaft, an interior handle supporting tube extending into said casing, a deadbolt opening pusher blade and a deadbolt closing pusher blade in said casing, said opening and closing pusher blades each having a first end rotatably mounted to said supporting tube, and a second end spaced from said first end, rotating means connected to a main bolt shaft to rotate said pusher blades relative to each other wherein the main bolt shaft rotates one of said pusher blades while the other pusher blade is not rotated, said opening pusher blade second end having an opening blade nose portion facing said closing pusher blade and an opening blade heel portion contacting a first wall of said casing, said closing pusher blade second end having a closing blade nose portion facing said opening pusher blade, and a closing blade heel portion contacting a second wall of said casing, said opening nose portion being spaced a predetermined distance from said closing nose portion, said eccentric being movable from a first position wherein said deadbolt is retracted and to a second position wherein said deadbolt is extended to a locking position, said closing blade nose portion being in contact with said eccentric when said deadbolt is retracted, said opening blade nose portion being in contact with said eccentric when said deadbolt is extended into locking position, and said deadbolt being extended and retracted by either turning an interior thumb turn or turning an exterior handle in an appropriate direction.

13. The deadbolt actuator of claim 12 wherein said casing has therein a dragger disk (8) attached to the main bolt shaft to rotate with said main bolt shaft, and means on said dragger disk to selectively rotate the opening and closing pusher blades relative to each other.

14. The deadbolt actuator of claim 13 wherein said dragger disk has a first and a second integral dragger lug diametrically opposite each other, said first dragger lug contacting said opening pusher blade and said second dragger lug contacting said closing pusher blade when said exterior door handle is in a resting position, said first and second dragger lugs and said opening and closing pusher blades being constructed to enable said first dragger lug to pivot the opening pusher blade and the second dragger lug to pivot the closing pusher blade when said dragger disk is selectively rotated.

15. The deadbolt actuator of claim 13 wherein a cam is attached to the deadbolt shaft in said casing, said cam having a control lobe in contact with an actuator when said deadbolt is extended and said lobe being sized such that when said deadbolt is retracted, said control lobe is not in contact with said actuator.

16. The deadbolt actuator of claim 14 wherein a cam is attached to the deadbolt shaft in said casing, said cam having a control lobe in contact with an actuator when said deadbolt is extended and said lobe being sized such that when said deadbolt is retracted, said control lobe is not in contact with said actuator.

17. The deadbolt actuator of claim 15 wherein said actuator is a microswitch.

18. The deadbolt actuator of claim 12 wherein said opening and closing pusher blades are mirror images of each other.

19. The deadbolt actuator of claim 13 wherein said opening and closing pusher blades are mirror images of each other.

20. The deadbolt actuator of claim 14 wherein said opening and closing pusher blades are mirror images of each other.

* * * * *